United States Patent [19]

Bertucci

[11] 4,101,299

[45] Jul. 18, 1978

[54] APPARATUS FOR DISCHARGING SMOKES, FUMES AND GREASES FROM KITCHENS

[75] Inventor: Albert Flamidien Bertucci, Golbey, France

[73] Assignee: Agence Nationale de Valorisation de la Recherche (ANVAR), Neuilly-sur-Seine, France

[21] Appl. No.: 755,002

[22] Filed: Dec. 28, 1976

[30] Foreign Application Priority Data

Dec. 31, 1975 [FR] France ..... 75 40315

[51] Int. Cl.[2] ..... B01D 47/00

[52] U.S. Cl. ..... 55/222; 55/242; 55/257 H; 55/257 E; 55/269; 55/442; 126/299 E; 55/DIG. 36

[58] Field of Search ..... 55/222, 242, 257 H, 55/257 E, 267–269, 442, DIG. 36, 440, 410; 126/299 D, 299 A, 299 E

[56] References Cited

U.S. PATENT DOCUMENTS 3,459,115 8/1969 Gutermuth ..... 55/DIG. 36

3,616,744 11/1971 Jensen ..... 55/242

FOREIGN PATENT DOCUMENTS 1,157,466 7/1969 United Kingdom ..... 55/440

*Primary Examiner*—Bernard Nozick

*Attorney, Agent, or Firm*—Karl W. Flocks

[57] ABSTRACT

The invention relates to a new device for discharging smokes, fumes and greases from various indoor premises and comprising a set of ceiling elements arranged with smoke, fumes and grease discharging slits therebetween.

It is characterized in that the ceiling elements it includes are hollow and crossed by water whose circulation is ensured by pipes interconnecting the elements, which elements form condensers with water-cooled heat-transfer surfaces.

Discharging of the grease deposits collected on the condensers is effected by washing with water containing a detergent, this water being supplied by spray-rails, while the washing water and the dissolved greases are collected by the drains.

Hoods are provided above the slits separating the drains (the later being close to one another) in order to completely secure the premises against dripping of the greases and washing water during the cleaning operation, which is performed only when it proves necessary.

7 Claims, 2 Drawing Figures

APPARATUS FOR DISCHARGING SMOKES, FUMES AND GREASES FROM KITCHENS

Figure 1:
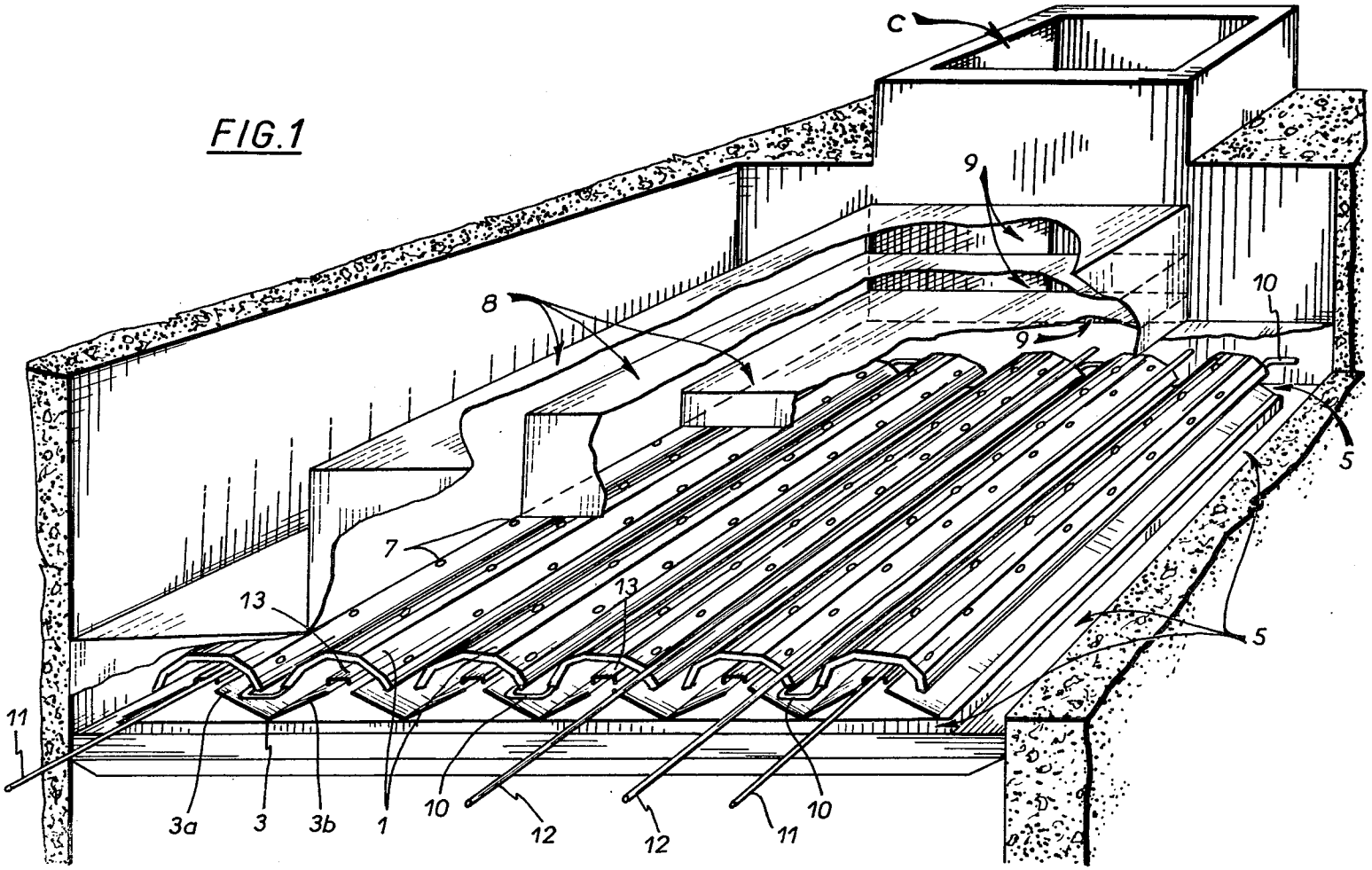

The present invention relates to a new device for discharging smokes, fumes and greases from various indoor premises, suitable more particularly but not exclusively for the severe conditions arising from intensive use of restaurant or community kitchens.

Already known are devices devoid of rotary elements and filters, comprising a set of ceiling elements arranged with smoke, fumes and grease discharging slits therebetween, the greases collected by the ceiling elements being discharged through drains connected to a sewer.

In one such device, spraying means outside the ceiling elements, in the form of wide cradles or thin solid hoops are provided in order to cause the liquid ejected by a pump to continuously encounter the upwardly sucked smokes and fumes, thereby to obtain a separation of the fumes from the dirt particles which are streamed downwards through the drains.

A drawback of this arrangement is that the premises are at all times in a damp atmosphere and that dripping away of the greases and the waters cannot be guaranteed.

In this same device the gap between the bottom edges of the ceiling elements and the liquid level in the drains is kept so small that when the depression prevailing above the ceiling elements causes the gap between these edges and the liquid level to close intermittently, oscillations can be produced in such liquid. As a result of these oscillations, the particles sucked up by the air that have not become fixed in the layer of liquid covering the ceiling elements are then captured by the liquid.

This invention relates to a device for discharging smokes, fumes and greases from indoor premises, characterized in that the ceiling elements it includes are hollow and crossed by water whose circulation is ensured by pipes interconnecting the elements, which elements form condensers with water-cooled heat-transfer surfaces.

Preferably, each condenser is shaped like a long gutter tile having its concave surface turned downwardly.

Discharging of the grease deposits collected on the condensers is effected by washing with water containing a detergent, this water being supplied by spray rails, while the washing water and the dissolved greases are collected by the drains.

Hoods are provided above the slits separating the drains (the latter being close to one another) in order to completely secure the premises against dripping of the greases and washing water during the cleaning operation, which is performed only when it proves necessary.

The description which follows with reference to the accompanying non-limitative exemplary drawings will give a clear understanding of how the invention can be carried into practice.

Figure 2:
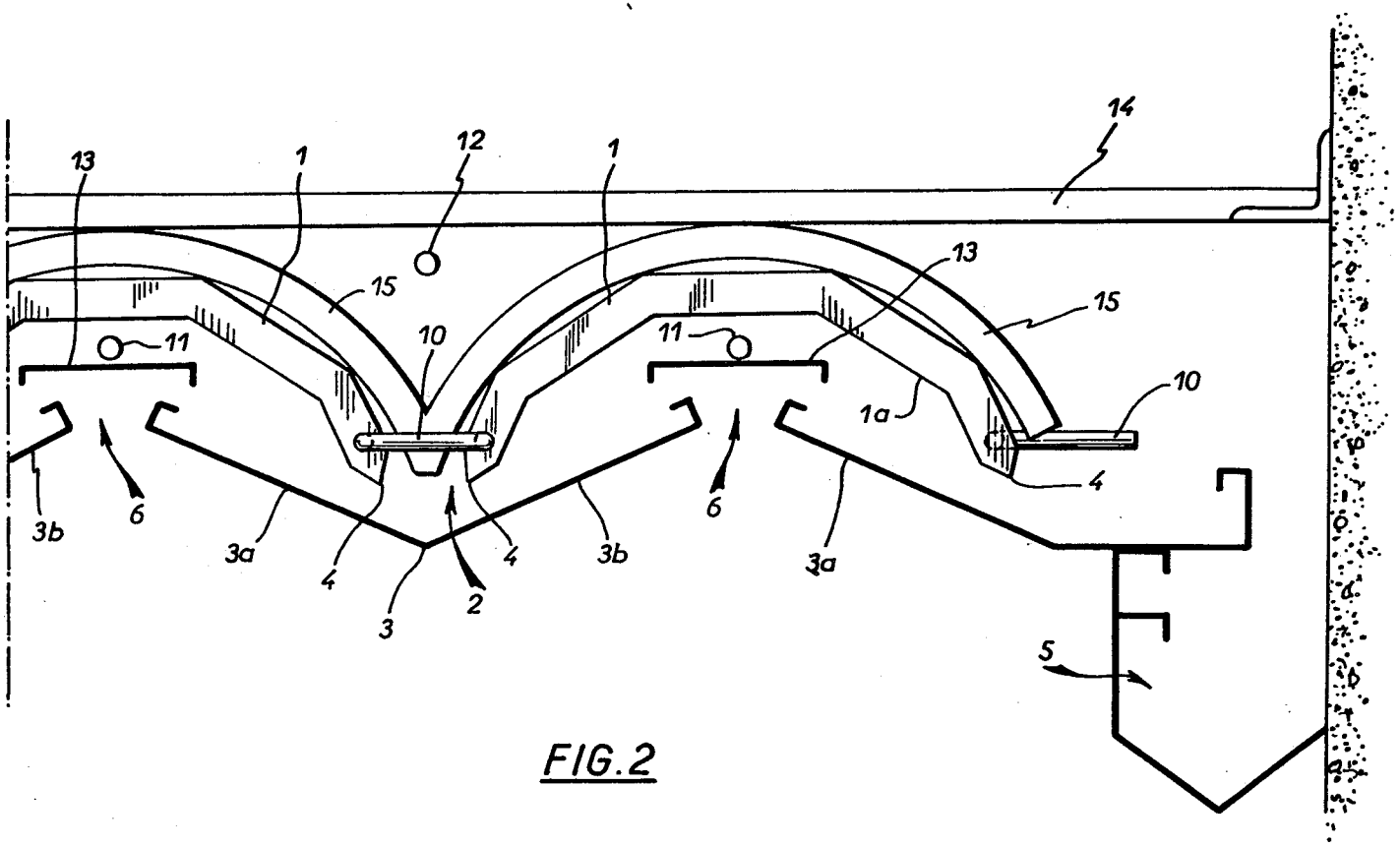

In the drawings:

FIG. 1 is a perspective view, with cutaway portions, of a discharging ceiling according to this invention; and FIG. 2 shows in front elevation, on an enlarged scale, some of the elements of said ceiling.

In the illustrated form of embodiment, the subject device of this invention occupies the upper part of a restaurant or community kitchen and forms the ceiling or false-ceiling thereon. It permits discharging of smokes, fumes and greases, the latter being captured by a heat-transfer surface.

More specifically, the ceiling is formed by a set of water-cooled condensers 1, arranged parallel to one another and having smoke and fume discharging slits 2 therebetween. Each is in the shape of a long gutter tile with its concave surface turned downwardly, in such manner that the greases can be captured by this transfer surface 1*a* and then discharged by drains positioned beneath the condensers.

Each drain is formed by two flat drainage surfaces 3*a*, 3*b* joined to form an edge 3, with each curved condenser portion having a drainage flat beneath it. Each gutter-tile-shaped condenser can in fact be regarded as having, on either side of a longitudinal axis, a curved portion that terminates in a tapered edge 4 to assist dripping.

The drains 3*a*–3–3*b* empty into a peripheral sewer 5 which communicates in turn with the kitchen's grease pan and main sewer.

Slits 6 are formed between the drains and provide an initial passageway for the smokes and fumes.

The successive passages by the smokes and fumes through the slits 6 and thereafter through the slits 2 slow down the speed of such smokes and fumes to assist depositing of the greases on the condensers.

In addition to the slits 6 and the slits 2, the smokes and fumes pass through the passage provided by vents 7 extending through the condensers and reaching up to the discharge chimney C with which the kitchen is provided. Flues 8 direct the smokes and fumes into openings 9 having port in the discharge chimney. these flues are tiered and their passageway sections are calculated according to the distance of their offtake points in the ceiling area from the discharge chimney. The most distant flue is larger in size than the other flues, each having a passageway section greater then the next nearest flue to the chimney. It has proved effective to provide flue sections such that their sum be substantially equal to the discharge section of the chimney.

Water circulation through the gutter-tile-shaped condensers is provided by pipes 10 which interconnect them in series, the whole system being preferably caused to communicate with the kitchen's hot-water installation, which can thus recover the heat picked up by the cooling water.

Discharging of the grease deposits on the condensers 1, at the time of the cleaning operation effected from time to time, is accomplished by washing with water containing a detergent for example, this water being supplied by spray-rails, some of which 11 are provided below the condensers, and the others 12 above the slits 2 separating them. The washing water and the dissolved greases are collected in the drains 3*a*–3–3*b*.

Hoods 13 are provided above the drain separation slits 6 in order to secure the kitchen against dripping of the greases and washing water.

The condensers having the general form of tile gutters are preferably made from sectors welded together. They are fixed to a main structure 14 having arches 15, and weld points unite the upper joint edges of the sectors with the arches 15.

It goes without saying that the present invention is by no means limited to the preferred embodiment described and illustrated for exemplary purposes, and that changes and substitutions of parts may be made without departing from the scope of the invention as defined in the appended claims.

Thus this invention may also be applied with advantage to any other premises or rooms in buildings, such as industrial laboratories, factories, etc.

Similarly, the long condensers can be arranged in a direction perpendicular to that adopted for the embodiment described and illustrated herein, that is to say, perpendicularly to the discharge flues 8, or in any other covenient direction.

Lastly, to assist the discharging of grease deposits on the condensers, hot water can be caused to flow through the condensers during the cleaning operation.

I claim:

1. An installation for discharging smoke, fumes and greases from various premises, more particularly from restaurant or community kitchens comprising a set of hollow ceiling elements each shaped as a long hollow gutter tile having its concave surface facing downwardly and having slits therebetween for discharging smoke and fumes, a water circulation pipe system, piping means connecting said hollow elements for passage of water between and through said elements, and connected to said water circulation pipe system, drains extending beneath said hollow elements with slits between said drains for the passage of smoke and fumes therebetween, said drains connected to a sewer, said hollow ceiling elements forming water-cooled condensers having heat-transfer surfaces for collecting the grease for discharge by said drains.

2. An installation as claimed in claim 1, further comprising:

a discharge chimney;

flues located over said ceiling elements for directing the smokes and fumes into said discharge chimney, said flues being tiered and their respective passageway sections being calculated for increasing size according to the increasing distance of their offtake points from said chimney.

3. An as claimed in claim 1, further comprising:

a kitchen hot-water installation, said cooling-water circulating pipes being caused to communicate with said hot-water installation, whereby the same recovers the heat transferred to the cooling water.

4. An installation as claimed in claim 1, further comprising:

said slits provided between said drains, which drains are close to one another, the successive passages of the smokes and fumes through these slits and thereafter through said slits provided between said condenser ceiling elements, causing a slowing down of said smokes and fumes, thereby to assist the depositing of greases on said ceiling elements.

5. An installation as claimed in claim 1, further comprising:

vents providing an additional passage for the smokes and fumes, which vents are provided in and extend through said condenser ceiling elements.

6. An installation as claimed in claim 1, wherein the longitudinal edges of said condenser ceiling elements are tapered in order to assist dripping.

7. An installation as claimed in claim 1, further comprising:

said slits provided between said drains, which drains are close to one another;

spray-rails, usable only for occasional washing purposes, arranged beneath said condenser ceiling elements;

spray-rails for washing purposes only, arranged above said slits separating said condenser ceiling elements, the washing liquid and the dissolved greases being collected by said drains;

hoods provided above said drain separating slits in order to secure the premises against dripping of greases and washing water.

* * * * *